United States Patent [19]

Fisher et al.

[11] 4,217,748

[45] Aug. 19, 1980

[54] SAFE WIRE ROPE

[76] Inventors: Charles B. Fisher, 2850 Hill Park Rd., Montreal, Quebec, Canada, H3H 1T1; Sidney T. Fisher, 53 Morrison, Montreal, Quebec, Canada, H3R 1K3

[21] Appl. No.: 63,454

[22] Filed: Aug. 3, 1979

[51] Int. Cl.[3] ..... D07B 1/16

[52] U.S. Cl. ..... 57/212; 57/206; 57/222; 57/223; 57/232

[58] Field of Search ..... 57/7, 32, 200, 206, 57/207, 210, 212, 213, 217, 218, 220, 221, 223, 232, 234, 241, 242, 250, 251, 258; 29/124, 125; 118/211; 174/24 R, 25 R, 27, 102 D, 126 CS, 176–179; 264/167, 174, 175 R

[56] References Cited

U.S. PATENT DOCUMENTS

| | | | |
|---|---|---|---|
| 1,382,723 | 6/1921 | Green | 57/220 |
| 1,397,718 | 11/1921 | Bellwald | 57/222 |
| 3,240,082 | 3/1966 | Bratz | 57/219 X |
| 3,522,699 | 8/1970 | Popradi | 57/216 |
| 3,831,370 | 8/1974 | Gilmore | 57/221 X |
| 3,928,519 | 12/1975 | Kashiyama et al. | 174/211 X |

*Primary Examiner*—Donald Watkins

[57] ABSTRACT

Steel wire rope used for lifting and hauling is dangerous when stressed above the breaking point, as there is a substantial quantity of energy stored in the stretched rope and when the rope breaks the stored energy causes the broken ends to whip at high velocity, in a number of recorded cases causing fatalities, and serious damage to helicopters, cranes, vessels and vehicles. This invention discloses a steel wire rope with a strong hand elastic sleeve or sleeves which are not in longitudinal tension, and which dissipate by friction the energy stored in the broken cable, thus materially reducing the possibility of damage to the surroundings.

4 Claims, 4 Drawing Figures

SAFE WIRE ROPE

BACKGROUND OF THE INVENTION

Steel wire rope is widely used for lifting and hauling purposes, often in considerable lengths. Good practice is to restrict the normal maximum stress to about 20% of the breaking load of the wire rope, but frequently conditions occur under which the wire rope is broken. The broken rope has a substantial amount of stored energy, which causes the broken ends to whip violently, often causing serious injury or damage. Wire rope is described in Mark's Standard Handbook for Mechanical Engineers, New York, 1967, pages 8-113 to 8-124.

We do not known of any prior patent art, publications or wire rope which are relevant to this invention.

SUMMARY OF THE INVENTION

A standard high-strength ½- inch wire rope 300 feet long has an approximate breaking strength of 21,400 pounds and stretches approximately linearly by about 20% of its length before breaking. Such a rope, weighing about 120 pounds, at breaking point stores the substantial amount of energy of about 642,000 foot-pounds, equal to 1130 horsepower-seconds.

In this invention this energy is largely absorbed by friction between the rope and a plurality of radially strong hard elastic close-fitting sleeves each attached to the wire rope at a separate point, at regular intervals.

The sleeves are not in tension in the stretched wire rope. The dissipation of energy occurs because the wire rope at breaking point is extended by some 20% of its length, and when the rope breaks it returns very quickly to its unstressed length, with considerable movement of the rope relative to the sleeves, which may have a total length equal to the length of the unstressed rope. This movement takes place under conditions of great friction, so that the stored energy of the broken rope is harmlessly dissipated as heat. The sleeves may be damaged by the friction and heat when the length of wire rope is broken. Steel is a suitable material for the sleeves. Each sleeve may be less or greater in length than a cable diameter.

LIST OF DRAWINGS

DETAILED DESCRIPTION OF THE INVENTION

Figure 1:
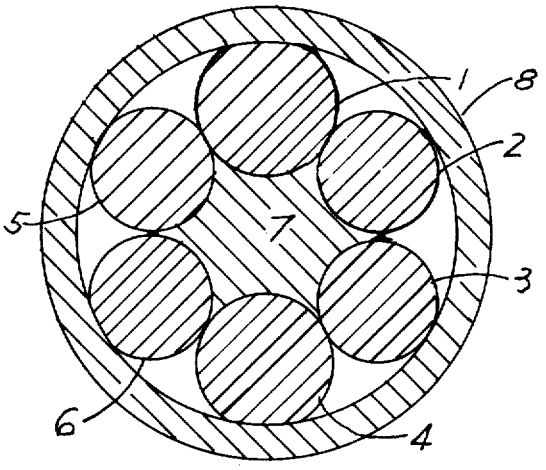
FIG. 1 shows a cross-section of a wire rope with a close-fitting hard strong elastic sleeve, according to the invention.

FIG. 1 shows a cross-section of a standard wire rope with a close-fitting strong hard elastic sleeve, according to the invention. A standard wire rope consists of 6 circular strands of wires twisted spirally into a rope of approximately circular section with a fiber core, each strand commonly consisting of 4, 7, 12, 19 or 37 spirally laid wires. The wire rope size is designated as the diameter of the enclosing circle. In FIG. 1, strands 1 to 6 inclusive, each in contact with the adjacent strands, are shown in a circular group around fiber core 7, with a close-fitting strong hard elastic sleeve 8. Sleeve 8 presses with considerable force at the point of contact with each strand, so that any movement of the sleeve 8 relative to the strands, at right angles to the plane of the drawing, is accompanied by substantial friction. The material of sleeve 8 is hard enough relative to the material of the wires in the strands that significant wear of the sleeve and the wires does not take place when such movement occurs. The internal surface of sleeve 8 may be roughened or have spiral or circumferential ridges to increase friction between the sleeve and the strands. Roughening and ridges may be shaped to give low friction when the rope is increased in length, and greater friction when each section of the rope reduces to its unstressed length after breaking.

When the wire rope is unstressed the sleeves are in circumferential tension and exert considerable radial pressure on the rope. As the wire rope is stressed in tension the rope decreases in diameter, but the prestressed sleeve continues to exert radial pressure on the rope, up to the instant of breaking of the rope. Each sleeve is attached by welding, crimping, or other means to the rope at one point, these points being uniformly spaced along the rope. There may be a small spacing between adjacent sleeves to increase flexibility of the rope.

In normal use with repeated safe loads not exceeding 20% of the breaking stress and subsequent releases the rope moves a relatively short distance in each sleeve, and wear may occur over this distance. With a breaking load applied of 5 times the normal load, the rope moves into previously unworn areas in the sleeves.

For safety reasons a length of rope of the prior art strained to breaking should be discarded and not repaired, as weak portions have undoubtedly developed. This is also true of a rope according to the invention. If it is necessary to repair and re-use such a rope after breaking, the sleeves should also be replaced if possible.

Figure 2:
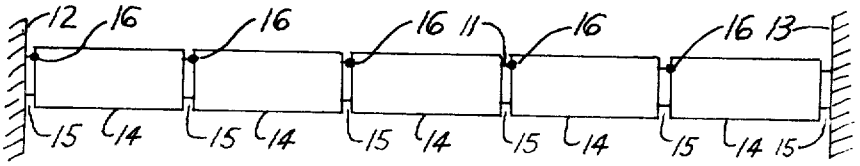
FIG. 2 shows a lateral view of an unstressed length of wire rope with a plurality of close-fitting hard strong elastic sleeves, according to the invention.

FIG. 2 shows a lateral view of an approximately horizontal but otherwise unstressed length of wire rope 11, according to the invention, with a plurality of 5 hard strong elastic sleeves of a approximately equal length 14, 14, 14, 14, 14, spaced by 6 small approximately equal distances 15, 15, 15, 15, 15, 15, attached to rope 11 at points 16, 16, 16, 16, 16, with rope 11 supported between surfaces 12 and 13. Sleeves 14 may have a length from a fraction of the rope diameter to a multiple of the rope diameter, depending on the cost and flexibility desired for the rope. Similarly spaces 15 may range from zero up to approximately the rope diameter, depending on the length of each sleeve and the cost and flexibility desired for the rope.

Figure 3:
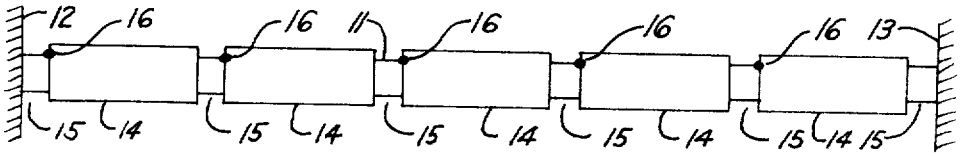
FIG. 3 shows a lateral view of a heavily stressed length of wire rope with a plurality of close fitting hard strong elastic sleeves, according to the invention.

FIG. 3 shows the rope of FIG. 2 stretched 20% in length, that is approximately to its breaking length. Note that the sleeves have not changed in length and the additional rope length is entirely in the spaces between the sleeves. The sleeves remain equally spaced.

Figure 4:
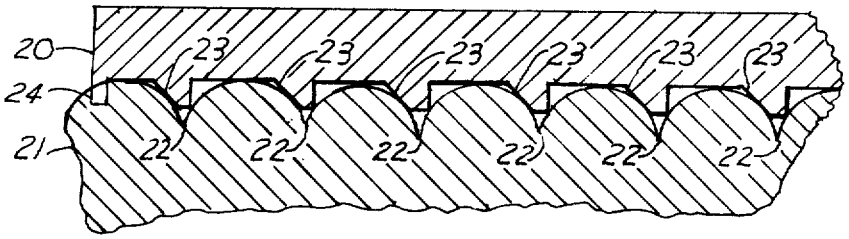
FIG. 4 shows a cross-sectional view of one type of ridged sleeve fitted to a wire rope, according to the invention.

FIG. 4 shows in diagrammatic form a cross-sectional view at 20 of part of one of the hard strong elastic sleeves of FIG. 2 in place on an unstressed standard wire rope. The section of rope 21 shown has repeated notches 22, 22, 22, 22, 22, 22, as the rope is made up of 6 spirally laid strands. The sections of sleeve 20 shown has a group of unsymmetrical spiralled ridges which show in section at 23, 23, 23, 23, 23, 23. These ridges are spaced at intervals approximately equal to the average spacing of notches 22 in rope 21. Due to the shape of ridges 23 they strongly resist the movement of rope 21 relevant to sleeve 20, if sleeve 20 is considered stationary and any portion of rope 21 under sleeve 20 moves to the left as the rope becomes shorter. For the opposite relative direction of motion, that is when the rope increases in length, much lesser friction is encountered, due to the sloping faces of ridges such as 23. Sleeve 20 is attached to rope 21 at one point or ring such as 24.

We claim:

1. A wire rope substantially free from whip when stressed to the breaking point, which comprises a length of wire rope with a plurality of strong, hard elastic sleeves which encircle and compress said rope.

2. A wire rope according to claim 1 in which said elastic sleeves are attached to said rope each at a different point, and have a length and spacing adequate to give said rope the required flexibility.

3. A wire rope according to claim 1 in which said sleeves have internally roughened or ridged surfaces to increase the friction with said rope.

4. A wire rope according to claims 2 or 3 in which said ridges on said sleeve are spirally formed to coincide approximately with spiral notches occurring in said rope when unstressed, and have a cross-sectional asymmetrical toothed shape which presents vertically rising surfaces to the ridges in said rope when said rope is being shortened, presents sloping surfaces to said ridges in said rope when said rope is being lengthened.

* * * * *